US005458956A

United States Patent [19]

Shi et al.

[11] Patent Number: 5,458,956

[45] Date of Patent: Oct. 17, 1995

[54] UV-RESISTANT AND DIMENSIONALLY STABLE TENT COMPRISING WOVEN POLYETHYLENENAPHTHALATEBI BENZOATE (PENBB) YARNS

[75] Inventors: Lie Shi; Dee A. Ling, both of Charlotte, N.C.; Michelle C. Carter, Madison, N.J.

[73] Assignee: Hoechst Celanese Corporation, Somerville, N.J.

[21] Appl. No.: 104,296

[22] Filed: Oct. 12, 1993

[51] Int. Cl.[6] ..... E04H 15/00; D03D 3/00; D03D 15/00

[52] U.S. Cl. ..... 428/229; 135/87; 428/225; 428/373

[58] Field of Search ..... 428/229, 373, 428/225; 135/87

[56] References Cited

U.S. PATENT DOCUMENTS 3,008,934 11/1961 Wielicki et al. ..... 260/75

FOREIGN PATENT DOCUMENTS 52-107319 9/1977 Japan .
9302122 2/1993 WIPO .

*Primary Examiner*—James D. Withers
*Attorney, Agent, or Firm*—Philip P. McCann

[57] ABSTRACT

A tent fabric constructed substantially of woven polyethylenenaphthalatebibenzoate (PENBB) yarns. The PENBB yarns of the fabric exhibit very low tenacity loss resulting from UV degradation, and exhibit very good dimensional stability, very low hot air shrinkage and very low creep. A flame retardant polymer may be added to the PENBB polymer before extrusion to provide flame resistance.

12 Claims, 6 Drawing Sheets

| MATERIAL | DAYS | DENIER | INITIAL MODULUS (G/D) | | BREAK TENACITY (G/D) | | ELONG AT BREAK (%) | |
|---|---|---|---|---|---|---|---|---|
| | | | AVG | %CHG | AVG | %CHG | AVG | %CHG |
| 37491-28-7 PENBB | 0 | 162.0 | 234.1 | | 8.85 | | 5.29 | |
| | 1 | 151.0 | 254.2 | 8.6 | 9.99 | 12.9 | 5.16 | -2.5 |
| | 2 | 159.0 | 234.4 | 0.1 | 9.05 | 2.4 | 5.03 | -5.0 |
| | 5 | 160.0 | 225.9 | -3.5 | 8.51 | -3.8 | 4.85 | -8.3 |
| | 10 | 163.0 | 225.5 | -3.7 | 8.24 | -6.8 | 4.63 | -12.5 |
| | 20 | 146.0 | 238.2 | 1.7 | 8.47 | -4.2 | 4.47 | -15.4 |
| 37452-17-4 PET | 0 | 97.0 | 138.8 | | 9.18 | | 9.95 | |
| | 1 | 101.0 | 99.7 | -28.2 | 6.00 | -34.6 | 9.30 | -6.6 |
| | 2 | 110.0 | 96.3 | -30.6 | 4.96 | -46.0 | 8.62 | -13.5 |
| | 5 | 102.0 | 104.8 | -24.5 | 3.15 | -65.7 | 7.17 | -28.0 |
| | 10 | 104.0 | 92.9 | -33.1 | 1.27 | -86.1 | 1.91 | -80.8 |
| | 20 | 93.0 | 110.2 | -20.6 | 0.60 | -93.5 | 0.62 | -93.8 |
| 37147-19-9 PEN | 0 | 105.0 | 201.7 | | 8.79 | | 4.69 | |
| | 1 | 107.0 | 187.4 | -7.1 | 8.09 | -8.0 | 5.63 | 19.9 |
| | 2 | 111.0 | 177.9 | -11.8 | 7.46 | -15.2 | 5.39 | 14.9 |
| | 5 | 107.0 | 172.3 | -14.6 | 7.50 | -14.7 | 5.87 | 25.2 |
| | 10 | 104.0 | 167.6 | -16.9 | 6.69 | -23.9 | 5.41 | 15.4 |
| | 20 | 91.0 | 178.0 | -11.7 | 6.96 | -20.9 | 5.31 | 13.2 |

FIGURE 3

| SAMPLE ID | DAYS | DENIER | INITIAL MODULUS (G/D) | | BREAK TENACITY (G/D) | | ELONG AT BREAK (%) | |
|---|---|---|---|---|---|---|---|---|
| | | | AVG | %CHG | AVG | %CHG | AVG | %CHG |
| 37452-17-4 PET | 0 | 96 | 122.4 | | 9.31 | | 8.51 | |
| | 1 | 99 | 134.3 | 9.7 | 7.89 | -15.2 | 8.14 | -4.3 |
| | 2 | 106 | 124.7 | 1.9 | 6.81 | -26.8 | 8.05 | -5.4 |
| | 5 | 96 | 134.5 | 9.9 | 5.53 | -40.6 | 6.59 | -22.6 |
| | 10 | 107 | 133.0 | 8.7 | 4.42 | -52.5 | 5.58 | -34.5 |
| | 20 | 105 | 127.0 | 3.8 | 2.76 | -70.3 | 4.20 | -50.6 |
| 37147-19-9 PEN | 0 | 107 | 232.3 | | 8.56 | | 4.87 | |
| | 1 | 105 | 231.1 | -0.5 | 8.01 | -6.4 | 4.70 | -3.5 |
| | 2 | 100 | 227.7 | -1.9 | 7.94 | -7.2 | 4.62 | -5.2 |
| | 5 | 107 | 227.2 | -2.2 | 7.43 | -13.2 | 4.67 | -4.1 |
| | 10 | 108 | 201.4 | -13.3 | 6.38 | -25.5 | 4.36 | -10.5 |
| | 20 | 107 | 192.5 | -17.1 | 5.32 | -37.9 | 3.89 | -20.1 |
| 37149-28-7 PENBB | 0 | 165 | 275.5 | | 9.64 | | 5.72 | |
| | 1 | 157 | 261.0 | -5.3 | 8.94 | -7.2 | 5.03 | -11.9 |
| | 2 | 164 | 262.2 | -4.8 | 8.39 | -13.0 | 4.87 | -14.8 |
| | 5 | 154 | 265.2 | -3.7 | 7.85 | -18.5 | 4.48 | -21.6 |
| | 10 | 157 | 248.8 | -9.7 | 6.96 | -27.8 | 4.09 | -28.4 |
| | 20 | 165 | 226.9 | -17.6 | 5.84 | -39.4 | 3.62 | -36.6 |

FIGURE 4

UV-RESISTANT AND DIMENSIONALLY STABLE TENT COMPRISING WOVEN POLYETHYLENENAPHTHALATEBIBENZOATE (PENBB) YARNS

TECHNICAL FIELD AND BACKGROUND OF THE INVENTION

This invention relates to a tent fabric which exhibits extremely good resistance to ultraviolet (UV) light and which also provide good dimensional and high temperature stability. A fabric which has good "dimensional stability" has a high modulus and high resistance to creep and therefore resists changes in shape during use. These are characteristics which enhance the performance and durability of tent material. This is an important consideration, particular in high performance tents used by explorers, military personnel, scientists and hikers under extreme conditions of heat, cold and humidity. As is evident, resistance to ultraviolet light prolongs other performance-enhancing characteristics which are engineered into the tent fabric. Even though the material is referred to in this application as "tent fabric", it is apparent that such fabrics also have application as awnings, tarps and other types of outdoor shelters and coverings, particularly for commercial and military use, equipment covers, outdoor seat covers and upholstery and similar products, belts, straps, webbing, balloon fabric. In general, the tent fabric as described in this application performs well as a substitute for cotton or conventional synthetic, or cotton/synthetic blend canvas or duck fabrics.

The tent fabric from which the tent is fabricated is woven of yarns spun or drawn from polyethylenenaphthalatebibenzoate (PENBB) fibers. This fiber and its synthesis is described in applicant's published PCT Application No. WO 93/02122. Research into the properties and characteristics of PENBB fibers has demonstrated that certain such properties and characteristics lend themselves to application in high performance tent fabrics and tents. PENBB fiber fabric exhibits many of the advantageous characteristics of polyethyleneteraphthalate (PET), such as light weight and good strength, while substantially exceeding other PET fiber characteristics which have heretofore been barriers to optimal fabric performance. Some conventional synthetic tent fabrics include nylon or PET fiber yarns.

PET fiber is known to exhibit very poor UV stability. See, I. Ouchi et al, 20 *J. Applied Polymer Science* (1976) at 1983. In contrast, PENBB exhibits exceptional UV stability.

SUMMARY OF THE INVENTION

Therefore, it is an object of the invention to provide a tent fabric and tent which exhibits excellent resistance to ultraviolet light.

It is another object of the invention to provide a tent fabric and tent which has a much higher initial modulus than PET.

It is another object of the invention to provide a tent fabric and tent which has excellent dimensional stability.

It is another object of the invention to provide a tent fabric which has low creep;

It is another object of the invention to provide a tent fabric and tent which has excellent high temperature property retention;

It is another object of the invention to provide a tent fabric which has very low hot air shrinkage.

These and other objects of the present invention are achieved in the preferred embodiments disclosed below by providing a tent fabric comprised substantially of woven polyethylenenaphthalatebibenzoate (PENBB) yarns.

According to one preferred embodiment of the invention, the PENBB yarns of the fabric exhibit a tenacity loss of 5 percent over twenty days resulting from UV degradation when tested in a QUV weatherometer in accordance with ASTM G-53, and a tenacity loss of 40 percent when tested in a Xenon weatherometer in accordance with ASTM G-53.

According to another preferred embodiment of the invention, the tent fabric comprises a 750 denier spun yarn plain weave fabric having approximately 30 picks per inch (12 picks per cm) and 30 warp ends per inch (12 picks per cm).

According to yet another preferred embodiment of the invention, the yarns of the tent fabric are 500 denier.

According to yet another preferred embodiment of the invention, the tent fabric exhibits a hot air shrinkage of between 0.5 and 1.5 percent.

It is another object of the invention to provide a tent fabric which exhibits warp-wise stretch of approximately 1.3 percent under a load of 200 pounds per inch (35 kg per cm).

According to yet another preferred embodiment of the invention, the PENBB yarns are spun yarns.

According to yet another preferred embodiment of the invention, the PENBB yarns are drawn yarns.

According to yet another preferred embodiment of the invention, the spun PENBB yarns exhibit creep of 1.0 percent at 50 percent break load for 2000 hours.

According to yet another preferred embodiment of the invention, the drawn PENBB yarns exhibit creep of 0.5 percent at 50 percent break load for 2000 hours.

According to yet another preferred embodiment of the invention, the tent fabric according to the various embodiments described in the application is constructed into a tent.

BRIEF DESCRIPTION OF THE DRAWINGS

Some of the objects of the invention have been set forth above. Other objects and advantages of the invention will appear as the invention proceeds when taken in conjunction with the following drawings, in which:

FIG. 3 is a table illustrating effects on various physical characteristics of yarns exposed to UV in a QUV Weatherometer;

FIG. 4 is a table illustrating effects on various physical characteristics of yarns exposed to UV in a Xenon Weatherometer;

DESCRIPTION OF THE PREFERRED EMBODIMENT AND BEST MODE

Figure 1:
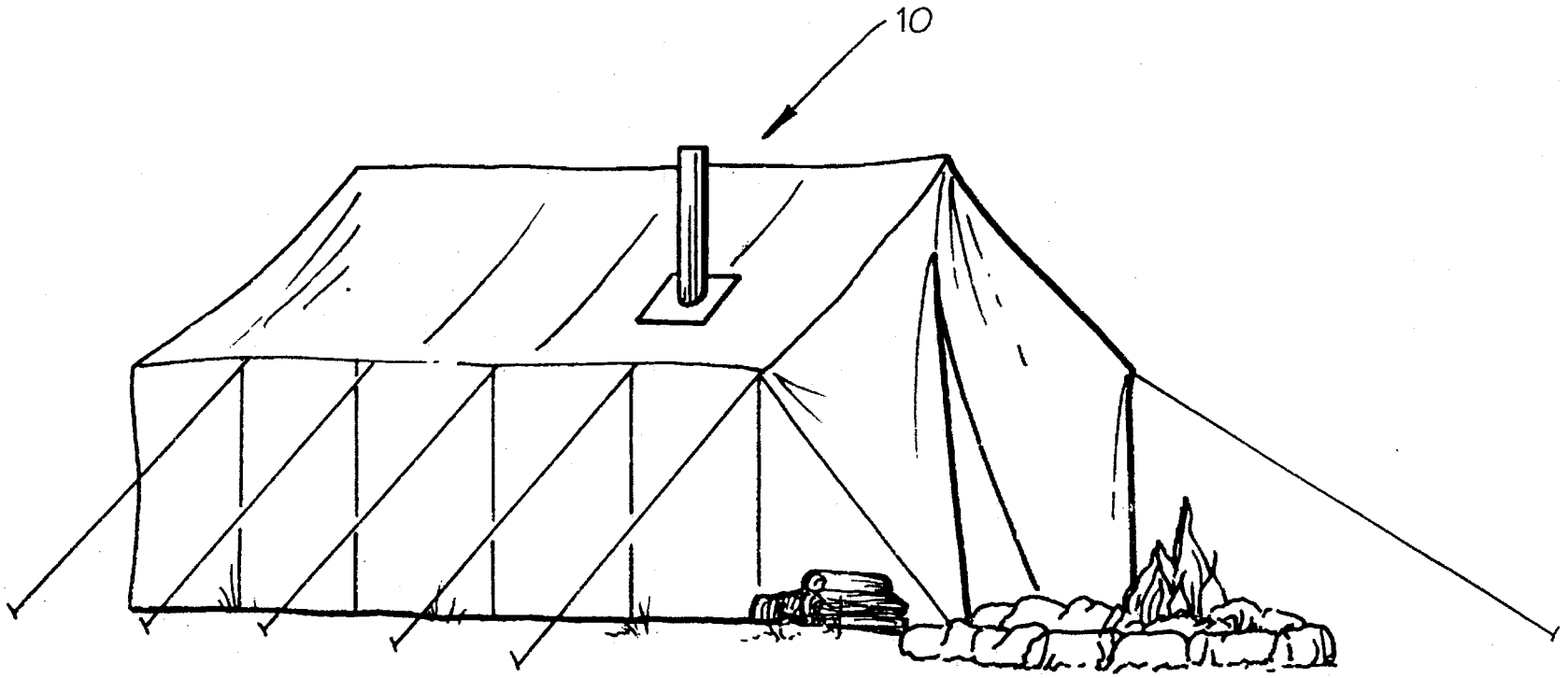
FIG. 1 is a overall perspective view of a tent fabricated from a PENBB fabric according to the present invention.

Referring now specifically to the drawings, a tent constructed of a fabric according to the present invention is illustrated in FIG. 1 and shown generally at reference numeral 10. The tent 10 is fabricated according to conventional tent construction techniques. The tent 10 can replace tents heretofore fabricated from PET, nylon or PPTA yarns. Tent 10 exhibits the desireable characteristics, i.e., light weight, ease of handling and non-moisture absorbency, of PET while exhibiting other characteristics, i.e., superior UV resistance and very good dimensional stability, which have heretofore generally unsatisfactory characteristics of PET or nylon fiber fabrics.

Fabrication of the tent 10 of PENBB basically involves substitution of PENBB yarns for conventional natural or synthetic-fiber yarns—the respective fibers being sufficiently similar in overall mechanical respects that changes in fabric design and construction will ordinarily be minimal. The differences in the two fibers—PENBB and PET—exhibit themselves in two primary modes. First, PENBB fibers and yarns exhibit greatly enhanced dimensional stability which directly results in an improvement in tent performance at any given time. Second, the inherent superior UV resistance permits the improved tent performance at any given time to extend substantially beyond the point in time when a comparably-constructed PET tent would have deteriorated to the point of needing repair or replacement.

EXAMPLE 1

A suitable tent fabric construction using PENBB yarns would be a fabric having 30 picks per inch (12 picks per cm) and 30 warp ends per inch (12 picks per cm) in a plain weave pattern, using 750 denier PENBB spun yarns without yarn twist. A flame-retardant polymer such as may be blended with the PENBB polymer before extrusion to provide enhanced flame resistance. Such a flame-retardant polymer may be a two or three component polyolefin containing a selected silica, as disclosed in U.S. Pat. Nos. 5,204,392 and 5,204,393, respectively, to applicant, or a polyester fiber having oxysilicon compounds, as disclosed in U.S. Pat. No. 5,180,793, to applicant. Many other flame-retardant compounds may be used, as required by the processing and end use characteristics of the end use product, including separately-applied surface coatings of known types.

The denier PENBB spun yarn has the following properties:

| | |
|---|---|
| Denier per filament | 10 |
| Tenacity (g/den) | 7.0 |
| Initial Modulus (g/den) | 250 |
| Elongation (%) | 6 |
| Hot Air Shrinkage | 0.5% at 177° C. |
| Moisture regain (%) | 0.14 |
| Density (g/cm3) | 1.38 |

Of course, tent fabrics according to the present invention can be constructed using various yarn constructions. Likewise, other ends uses, such as the covers, belts and straps referred to above will suggest differing yarn and fabric constructions.

EXAMPLE 2

A suitable tent fabric construction using PENBB yarns would be a fabric having 45 picks per inch (18 picks per cm) and 45 warp ends per inch (18 picks per cm) in a plain weave pattern, using 500 denier PENBB spun yarns without yarn twist. A flame-retardant polymer such as may be blended with the PENBB polymer before extrusion to provide enhanced flame resistance. Such a flame-retardant polymer may be a two or three component polyolefin containing a selected silica, as disclosed in U.S. Pat. Nos. 5,204,392 and 5,204,393, respectively, to applicant, or a polyester fiber having oxysilicon compounds, as disclosed in U.S. Pat. No. 5,180,793, to applicant. Many other flame-retardant compounds may be used, as required by the processing and end use characteristics of the end use product, including separately-applied surface coatings of known types.

The 500 denier PENBB spun yarn has the following properties:

| | |
|---|---|
| Denier per filament | 7 |
| Tenacity (g/den) | 8.5 |
| Initial Modulus (g/den) | 300 |
| Elongation (%) | 4 |
| Hot Air Shrinkage | 0.5% at 177° C. |
| Moisture regain (%) | 0.14 |
| Density (g/cm3) | 1.38 |

Yarn size according to preferred embodiments may be between 250–1500 denier, with a filament count of between 50–100. Denier per filament ranges may preferably be between 3–20.

Figure 2:
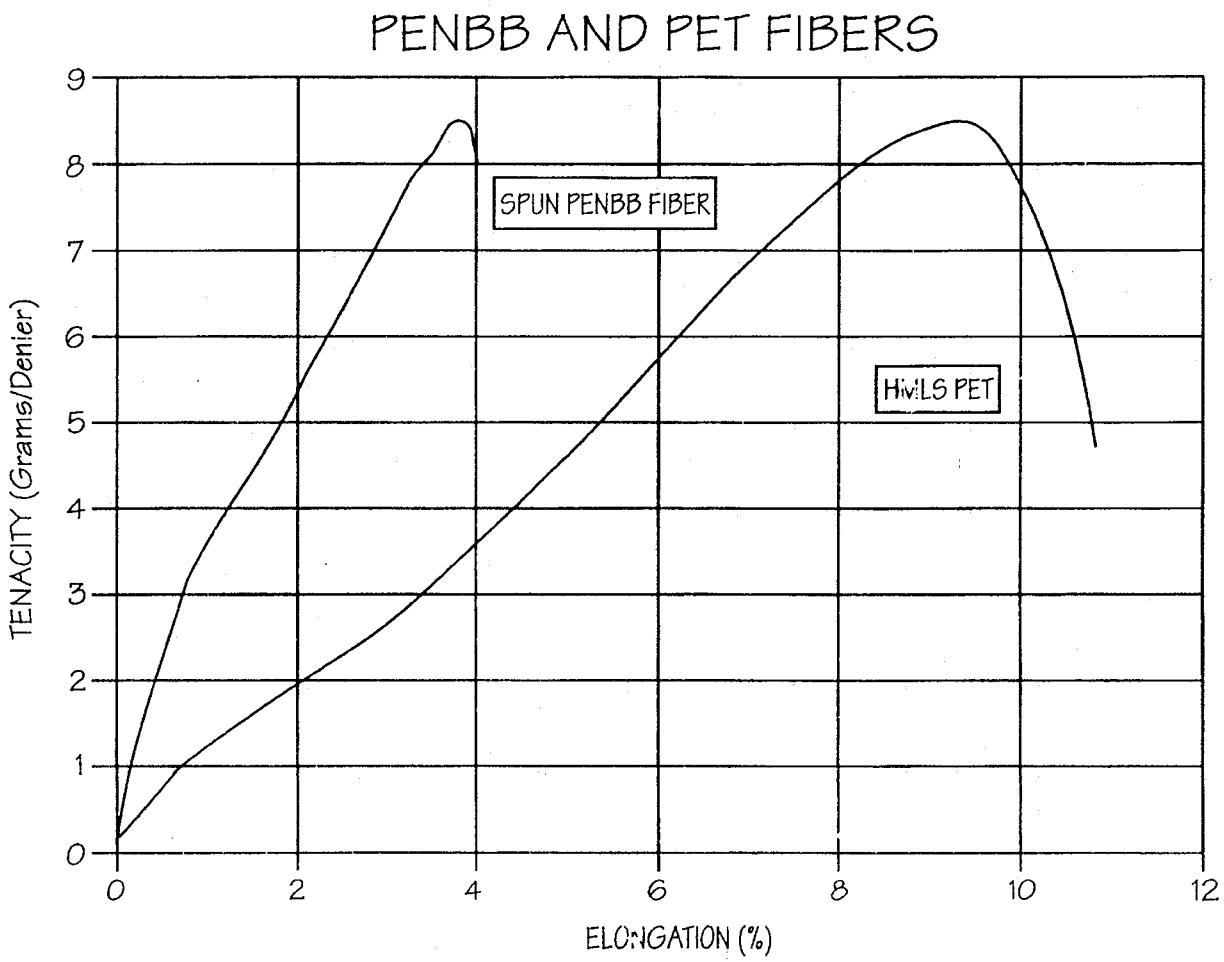
FIG. 2 is a chart plotting tenacity vs. elongation of PENBB spun fiber in comparison with a PET spun fiber.

Properties of PENBB are also shown in the several drawing figures. For example, in FIG. 2 a comparison is shown between the tenacity and elongation of PENBB and PET fibers. For example, a force of 5 grams per denier on PENBB will result in an elongation of 2 percent, whereas a like force on PET results in an elongation of approximately 5.5 percent. A force of 8 grams per denier on PENBB will result in an elongation of 4 percent, whereas a like force on PET results in an elongation of approximately 10 percent. Furthermore, note that at elongations of more than 9 percent, PET exhibits a substantial reduction in tenacity.

In a hypothetical example, an applied force of 200 pounds per inch (35 kg per cm) will stretch a conventional PET tent by 4 percent in the warp direction, but will stretch a PENBB tent of similar construction by only 1.3 percent or less. Thus, dimensional stability is three times greater for PENBB as contrasted with PET tents.

The effect of UV radiation on PENBB and PET fibers is shown in FIGS. 3 and 4.

In FIG. 3, the effects of a QUV Weathering Study comparing PENBB, PET and PEN (polyethylenenaphthalate) yarns is shown. Note the dramatic differences between the percent change in initial modulus, break tenacity and elongation at break between PENBB and PET—particularly at 10 and 20 days.

In FIG. 4, similar effects are noted in a Xenon weathering study which more closely approximates sunlight than the QUV Study of FIG. 3. Note again the dramatic differences in the percent change in initial modulus, break tenacity and elongation at break between PENBB and PET—particularly at 10 and 20 days.

Figure 5:
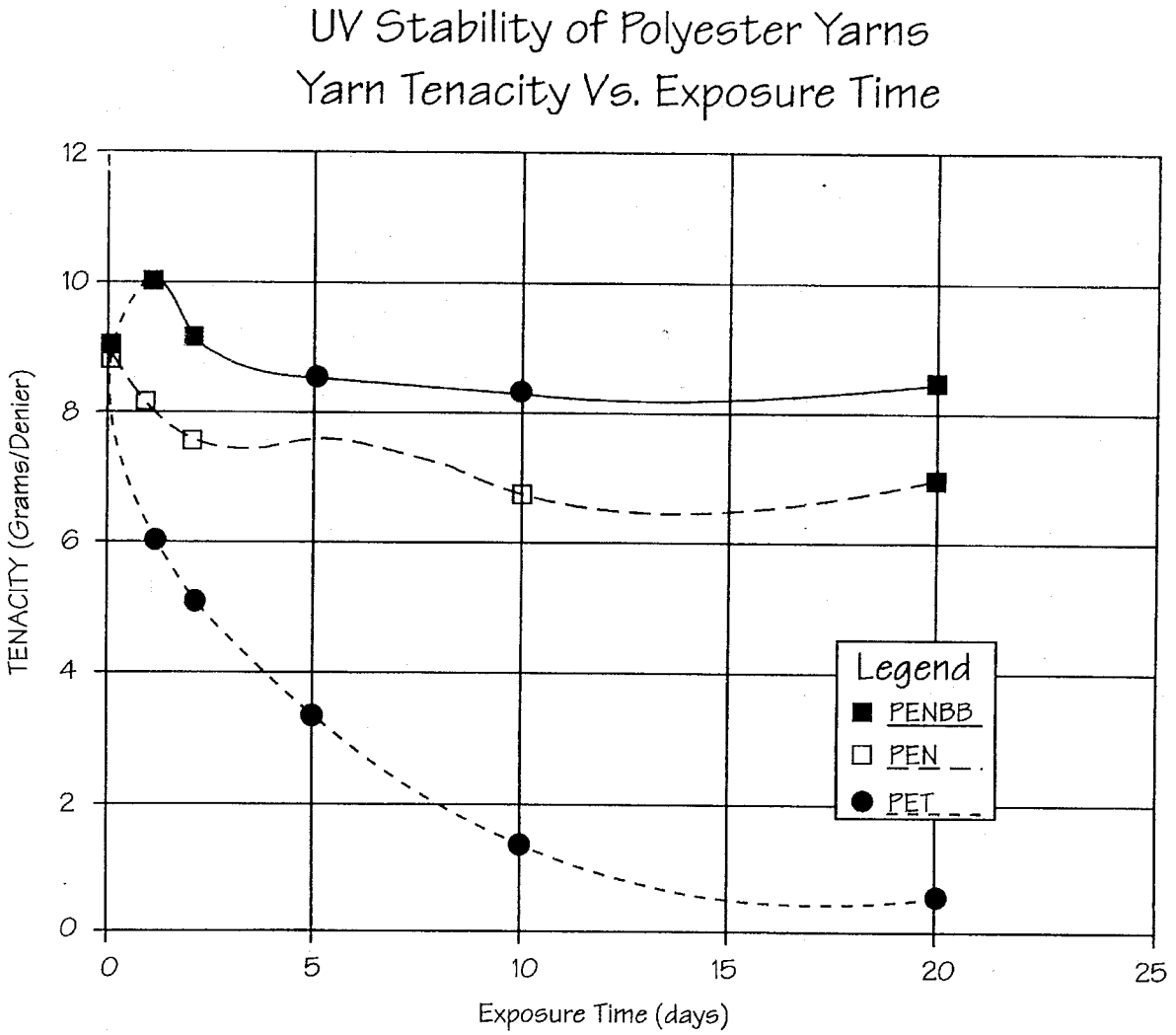
FIG. 5 is a chart plotting UV Stability of PENBB, PET and PEN yarns in terms of yarn tenacity vs. UV exposure time.
Figure 6:
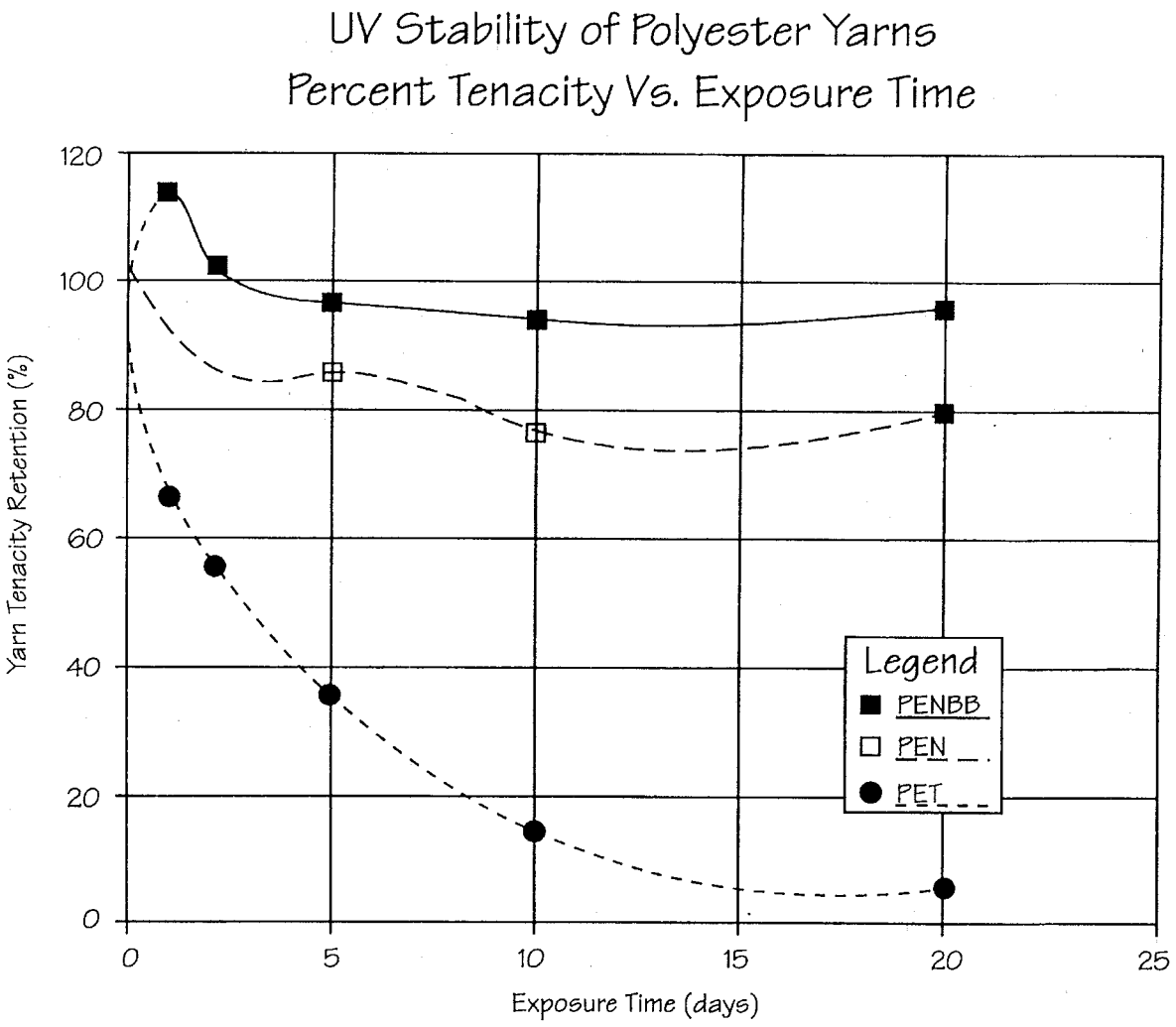
FIG. 6 is a chart plotting UV Stability of PENBB, PET and PEN yarns in terms of percent tenacity retention vs. exposure time.

The results of FIG. 3 is plotted in FIGS. 5 and 6. Note the dramatic differences between PENBB and PET yarns.

These differences translate directly into substantially improved service life for the tent 10. In particular, hot air shrinkage is substantially improved, with values of 0.5 to 1.5 percent hot air shrinkage at 177° C., as contrasted with 5.4 percent or greater for PET.

It has been determined from yarn studies that fabrics woven from PENBB yarns should exhibit much greater dimensional stability in the first 1 percent of stretch than similar fabrics of PET.

Creep resistance tests also show that at a 50 percent of break load for 2000 hours, PET yarns crept 1.5 percent, PENBB spun yarn 1.0 percent and PENBB drawn yarn 0.5 percent. The creep test was conducted by measuring the change in distance between two defined points on a loaded, vertically hung sample. The PENBB samples tested were 80 inches long, with no twist, and were loaded to 50% of their breaking loads.

A tent fabric and tent is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A tent fabric comprised substantially of woven polyethylenenaphthalatebibenzoate (PENBB) yarns.

2. A tent fabric according to claim 1, wherein said PENBB yarns of said fabric exhibit a tenacity loss of 5 percent over twenty days resulting from UV degradation when tested in a QUV weatherometer in accordance with ASTM G-53, and a tenacity loss of 40 percent when tested in a Xenon weatherometer in accordance with ASTM G-53.

3. A tent fabric according to claim 1, wherein said tent fabric comprises a fabric having a plain weave construction.

4. A tent fabric according to claim 3, wherein the yarns of said fabric are yarns having a denier of between 250 to 1500.

5. A tent fabric according to claim 4, wherein said fabric exhibits a hot air shrinkage of between 0.5 and 1.5 percent.

6. A tent fabric according to claim 4, wherein said fabric exhibits warp-wise stretch of approximately 1.3 percent under a load of 200 pounds per inch.

7. A tent fabric according to claim 1, wherein the PENBB yarns are spun yarns.

8. A tent fabric according to claim 1, wherein the PENBB yarns are drawn yarns.

9. A tent fabric according to claim 7, wherein said spun PENBB yarns exhibit creep of approximately 1.0 percent at 50 percent break load for 2000 hours.

10. A tent fabric according to claim 8, wherein said drawn PENBB yarns exhibit creep of approximately 0.5 percent at 50 percent break load for 2000 hours.

11. A tent fabric according to claim 1, wherein said woven PENBB yarns includes a flame retardant polymer added before extrusion to provide flame resistance to the tent fabric yarns constructed from the woven PENBB yarn.

12. A tent constructed from the fabric according to claims 1, 2, 3, 4, 5, 6, 7, 8, 9, 10 or 11.

* * * * *